US007262367B2

(12) United States Patent
Donzel et al.

(10) Patent No.: US 7,262,367 B2
(45) Date of Patent: Aug. 28, 2007

(54) HIGH VOLTAGE BUSHING WITH FIELD CONTROL MATERIAL

(75) Inventors: Lise Donzel, Wettingen (CH); Felix Greuter, Rutihof (CH); Hansjoerg Gramespacher, Niederrohrdorf (CH)

(73) Assignee: ABB Research Ltd, Zurich (CH)

( * ) Notice: Subject to any disclaimer, the term of this patent is extended or adjusted under 35 U.S.C. 154(b) by 0 days.

(21) Appl. No.: 11/079,858

(22) Filed: Mar. 15, 2005

(65) Prior Publication Data

US 2005/0199418 A1 Sep. 15, 2005

(30) Foreign Application Priority Data

Mar. 15, 2004 (EP) ..... 04405151

(51) Int. Cl.
*H01B 17/26* (2006.01)

(52) U.S. Cl. ..... 174/142; 174/137 R; 174/152 R; 174/143

(58) Field of Classification Search ..... 174/137 A, 174/137 R, 140 C, 142, 143, 178, 179, 181, 174/189, 195, 196, 209, 135, 152 G, 152 R; 248/56; 16/2.1, 2.2
See application file for complete search history.

(56) References Cited

U.S. PATENT DOCUMENTS 1,484,051 A * 2/1924 Austin ..... 174/178
3,261,910 A * 7/1966 Jacquier ..... 174/178
3,318,995 A 5/1967 Buckley et al.
3,839,593 A * 10/1974 Meier et al. ..... 174/178
4,272,642 A 6/1981 Classon
4,905,118 A * 2/1990 Sakich ..... 174/178
5,214,249 A * 5/1993 Goch et al. ..... 174/179
6,441,310 B1 * 8/2002 Niedermier et al. ..... 174/178
6,534,721 B2 3/2003 Hoefner
6,864,432 B2 * 3/2005 Boettcher et al. ..... 174/179

FOREIGN PATENT DOCUMENTS

GB 842039 7/1960
WO WO99/33065 A1 7/1999

OTHER PUBLICATIONS

European Search Report.

* cited by examiner

*Primary Examiner*—Angel R. Estrada
(74) *Attorney, Agent, or Firm*—Buchanan Ingersoll & Rooney PC

(57) ABSTRACT

The invention pertains to a dielectric bushing (1'), in particular a high-voltage bushing (1') for an electrical high-voltage apparatus. To realize the field control in the field-stressed zone (7; 7*a*, 7*b*), at least one screening electrode (6; 6*a*, 6*b*) arranged in the interior (20) of the insulator part (2; 2*a*, 2*b*; 2*c*) is eliminated and replaced with a non-linear electric and/or dielectric field control element (9; 9*a*, 9*b*; 9*i*, 9*o*; 9*s*) on the insulator part (2; 2*a*, 2*b*; 2*c*) in the region of the first installation flange (4; 8).

21 Claims, 6 Drawing Sheets

HIGH VOLTAGE BUSHING WITH FIELD CONTROL MATERIAL

TECHNICAL FIELD

The invention pertains to the field of high-voltage or medium-voltage engineering, particularly to electrical insulating and connecting techniques for grounded high-voltage apparatuses. The invention is based on a dielectric bushing and an electrical high-voltage apparatus according to the preambles of the independent claims.

STATE OF THE ART

The invention refers to the state of the art, as is known from WO 02/065486 A1. This publication discloses a high-voltage insulator, e.g., of porcelain or composite material, with a coating of field control material (FGM). The field control coating consists of varistor powder, e.g. of doped zinc oxide (ZnO) that is embedded in a polymer matrix. The FGM coating serves for homogenizing the field distribution on the insulator surface and is distributed such that part of the material is in electric contact with the ground electrode as well as with the high-voltage electrode. In this case, the FGM coating may only cover the insulator length partially and be concentrated in the field-stressed electrode regions. The FGM coating may be applied on the insulator surface, incorporated into a screening at this location or screened relative to the outside by means of a weather-proof, electrically insulating protective layer. A homogenization of the capacitive field stress can be realized with alternating horizontal strips or bands of FGM coating and insulating material.

In porcelain insulators, the FGM coating may be applied in the form of a glazing or a coat of paint, mixed into a paste or into clay, or applied on the porcelain insulator and fired such that a glazing or a ceramic layer is formed. Alternatively, the matrix for the FGM coating may consist of a polymer, an adhesive, a casting mass or a mastic or a gel.

EP 1 042 756 discloses a glass-fiber reinforced insulating tube that is impregnated with a resin on the inside surface and, if so required, on the outside surface, wherein said resin contains a particulate filler with varistor properties, particularly zinc oxide. The glass-fiber reinforced plastic (GFK) tube can be manufactured by winding up a glass-fiber netting, at least the outer layers of which are impregnated with the varistor-filled resin.

Various types of electrical bushings are disclosed in Chapter 3.13, "Electrical Bushings" by L. B. Wagenaar, pp. 3-171-3-184 in the book "The Electric Power Engineering Handbook" by L. L. Grigsby, CRC Press and IEEE Press, Boca Raton (2001). FIG. 3.151, in particular, shows a bushing with a grounded screening electrode that is arranged within the insulating tube. Due to the screening electrode, a field control is achieved in the region of the grounded installation or mounting flange such that the highly field-stressed zone is relieved at the transition from the flange to the insulator. Interior screening electrodes of this type are absolutely imperative in compressed gas-insulated bushings, e.g. in $SF_6$-insulated or air-insulated bushings, particularly for high-voltage applications. Interior screening electrodes are also known for solids-insulated bushings. However, the screening electrodes lead to large diameters of the bushings. In addition, screening electrodes only make it possible to achieve relatively inhomogeneous field controls in comparison with capacitor bushings with oil-impregnated or resin-impregnated paper. This needs to be compensated with larger structural heights of the bushings.

The brochure "$SF_6$-air bushings, type GGA", Technical Guide, Mar. 30, 1996 by ABB Power Technology Products AB discloses dielectric bushings that are equipped with internal screening electrodes on the grounded flange and, for higher voltage levels, with additional screening electrodes on the flange on the voltage side.

DE 198 44 409 discloses an insulator that is suitable, in particular, for dielectric bushings. The insulator conventionally comprises an insulator body of porcelain or composite material and a screening of porcelain or silicone. The screening has a variable insulating screen density. A customary screening electrode is also provided between the insulator body and the conductor in order to relieve the field stress in an insulator end region. This publication proposes to arrange a larger number of insulating screens in the highly field-stressed region where the screening electrode ends. The field stress is relieved in an improved fashion in the end region of the screening electrode due to the increased insulating screen density.

DESCRIPTION OF THE INVENTION

The present invention is based on the objective of disclosing an improved dielectric bushing, as well as an electrical high-voltage apparatus and an electrical switchgear with such a bushing. According to the invention, this objective is attained with the characteristics of the independent claims.

The invention proposes a dielectric bushing, particularly a high-voltage bushing for an electrical high-voltage apparatus, that comprises an insulator part with a first installation flange and a second installation flange for installing the bushing, wherein a screening electrode required for the desired voltage level is omitted within the bushing in a field-stressed zone in the region of the first installation flange, and wherein a non-linear electric and/or dielectric field control element is instead provided in the field-stressed zone on the insulator part within the region of the first installation flange for field control purposes. The invention makes it possible to omit the screening electrode that, according to the previous technical knowledge, was necessarily present for a predetermined voltage level. This results in numerous advantages. The omission of the thus far required interior screening electrode makes it possible to realize the dielectric bushings in a thinner fashion, i.e. with a reduced diameter. The voltage limit, beginning at which a conical widening toward the grounded flange is more economical, can be shifted toward higher voltage levels. Cylindrical bushings can be manufactured more economically than conical bushings. The risk of electric sparkovers between adjacent bushings is reduced and adjacent phases can be spatially arranged closer to one another or closer to the ground. The relief of the field stress according to the invention by means of a field control material in the flange region also results in a superior field control in comparison with conventionally utilized screening electrodes. Consequently, the bushings can also have a shorter structural length. Under a pulsed stress, in particular, the E-field is no longer concentrated within the region of the screening electrode during the entire pulse duration, but is rather able to propagate and thereby to decay along the field control element in the form of a wave. In addition, the maximum field strengths are also reduced.

According to a first embodiment, the field control material is designed, with respect to its non-linear electric and/or dielectric properties, its geometric shape and its arrangement on the insulator part, for achieving a dielectric relief of the field-stressed zone without a screening electrode in all operating states, particularly for impulse voltages. Consequently, the field control element is also able to manage critical field stress states without a screening electrode or screening electrodes.

Claim 3 discloses design criteria for an electrical design of the field control material that makes it possible to realize an advantageous field control.

Claims 5 and 6 disclose design criteria for the geometric design of the field control element that make it possible to achieve an advantageous field control with a low material expenditure. Claim 6, in particular, defines a minimum required length of the field control element along the longitudinal direction of the insulator part. Due to this measure, the field stress, particularly under impulse voltages, propagates along the field control element in the form of a traveling wave and decays during this process to such a degree that no damaging field strengths can occur any longer once the distant end of the field control material is reached.

Claim 7 discloses how d.c. bushings can be easily manufactured with the field control element.

The embodiments according to claim 8 and claim 9 provide the advantage that, in particular, the highest field stresses can be managed with the field control material in the region of the grounded flange.

The embodiments according to claims 10 and 11 provide the advantage that both flange regions are protected from sparkovers or partial discharges independently of one another by the field control materials.

Claim 12 defines various radial positions for arranging the field control material on the insulator part. Claim 13 provides the advantage that a conventional GFK (glass-fiber reinforced plastic) tube or a conventional porcelain insulator can be replaced with a self-supporting FGM tube (field control material tube).

Claim 14 discloses advantageous material components for the field control element.

Claims 15 and 16 pertain to an electrical high-voltage apparatus and an electrical switchgear assembly comprising a bushing according to the invention with the above-described advantages.

Other embodiments, advantages and applications of the invention are disclosed in the dependent claims as well as in the following description and the figures.

BRIEF DESCRIPTION OF THE FIGURES

FIGS. 2*a*-2*d* show cross sections through embodiments of a FGM bushing for a GFK tube with silicone screening, wherein FIG. 2*a* shows a continuous FGM coating, FIG. 2*b* shows a FGM coating on the grounded side, FIG. 2*c* shows respectively independent coatings on the grounded side and the high-voltage side, and FIG. 2*d* shows an interior and an exterior FGM coating;

Identical components are identified by the same reference symbols in the figures.

WAYS FOR IMPLEMENTING THE INVENTION

Figure 1A:
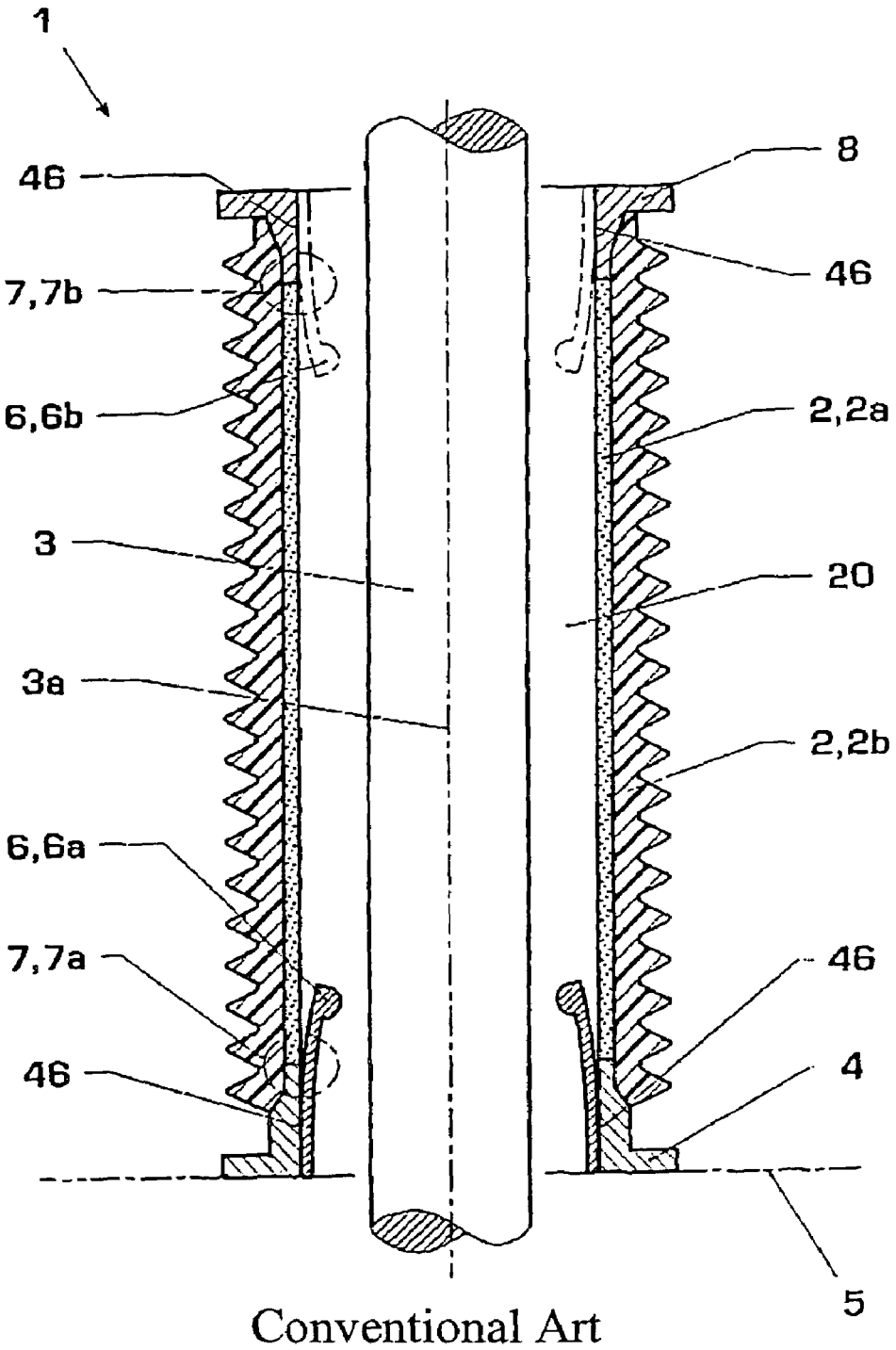
Conventional Art Fig. 1a
FIGS. 1*a*, 1*b* show cross sections through conventional high-voltage bushings according to prior art.

FIG. 1*a* shows a conventional gas-insulated dielectric bushing 1, particularly a high-voltage bushing 1 for an electrical high-voltage apparatus. The bushing 1 comprises an insulator part 2; 2*a*, 2*b* with a first installation flange 4 on the grounded side that serves for installing the bushing 1 on a grounded housing 5 of a (not-shown) electrical apparatus and a second installation flange 8 on the voltage side that serves for installing the bushing 1 on a (not-shown) high-voltage section or high-voltage part. The interior of the insulator part 2; 2*a*, 2*b* contains a gas chamber 20 for an insulating gas 20*g*. The gas chamber 20 contains a dielectrically insulating gas 20*g*, e.g. air, compressed air, nitrogen, SF6 or a similar gas. It would also be conceivable to provide an insulating chamber 20 for accommodating an insulating liquid 20*l*. The gas-insulated bushing 1 consequently is realized in a hollow fashion, particularly in the form of a hollow cylinder with an axis 3*a* for receiving an electrical section 3 or at least an electric conductor 3 in the gas chamber 20. The bushing 1 usually serves for connecting the encapsulated electrical apparatus, that is connected to the ground potential 5, to a high-voltage or medium-voltage network. As is known, an interior screening electrode 6, 6*a* needs to be provided in order to relieve the field stress in the field-stressed zone 7, 7*a* on the lower grounded flange 4 and to reduce or prevent partial discharges and sparkovers. The screening electrode 6, 6*a* is typically in electric contact 46 with the grounded flange 4. It protrudes into the gas chamber 20 and is usually tapered upward in a conical fashion. It defines the diameter of the bushing 1 in the region of the grounded flange 4. The broken lines indicate another screening electrode 6, 6*b* that may be arranged in the field-stressed zone 7, 7*b* on the upper flange 8 on the voltage side. This additional electrode is also frequently tapered downward in a conical fashion and serves for the field control in the field-stressed zone 7, 7*b*.

Figure 1B:
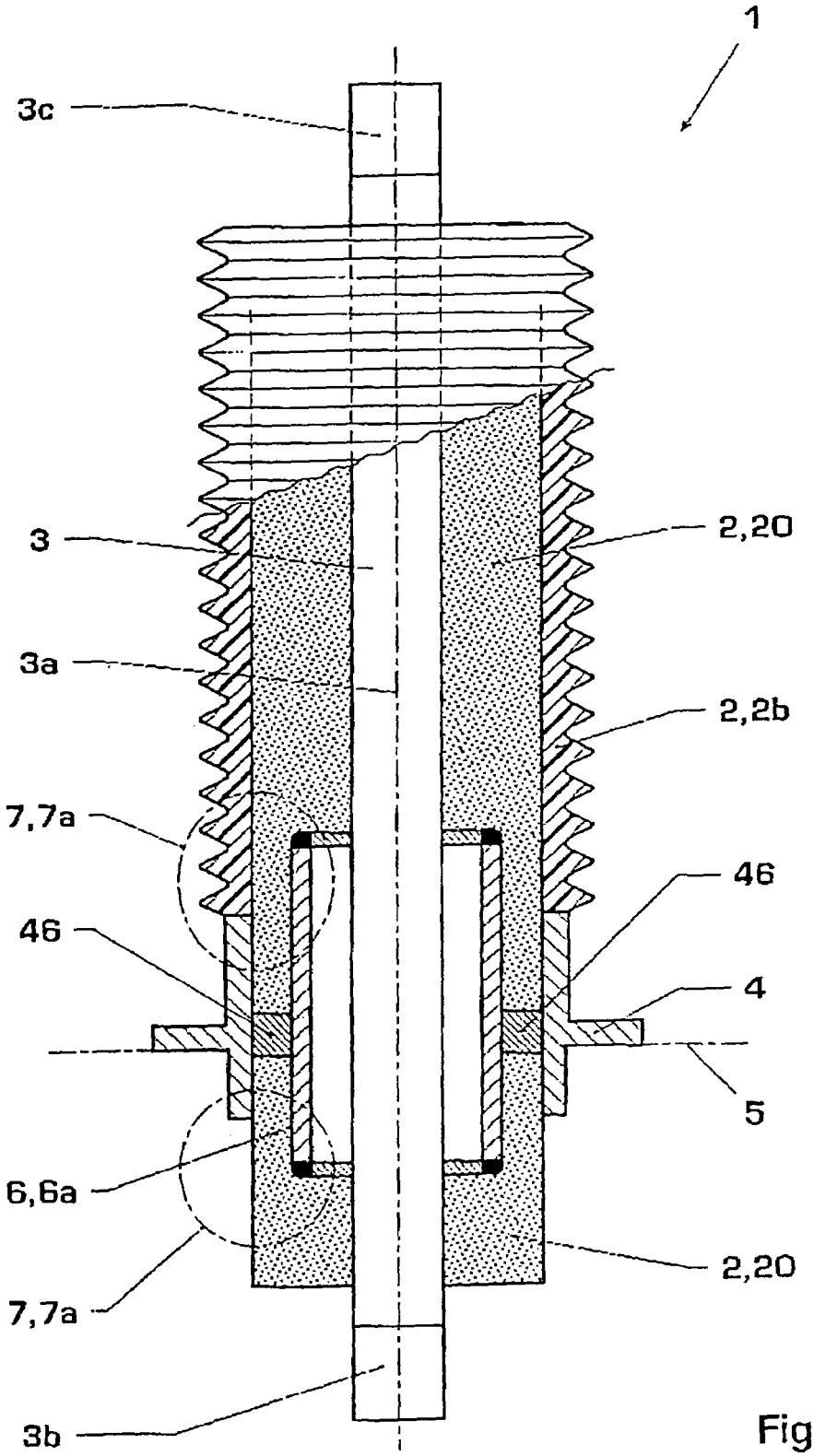
Fig. 1b Conventional Art

FIG. 1*b* shows an example of a solid-insulated bushing 1 according to the state of the art. In this case, the insulator part 2, 2*b* is realized in the form of a resin body 2 that may be provided with an optional screening 2*b* and has a completely filled interior volume. The insulator part 2, 2*b* consequently contains in its interior an insulating chamber 20 for a solid insulating material 20*s*. The reference symbols 3*b* and 3*c* identify the supply terminals. The insulator part 2, 2*b* encompasses the conductor 3. In order to realize the field control, a screening electrode 6, 6*a* is again provided on the grounded flange 4 in the field-stressed zone 7, 7*a* and is connected thereto in an electrically conductive fashion by means of a contact 46.

FIGS. 2*a*-2*d* and FIGS. 3*a*-3*b* show embodiments of a gas-insulated or solid-insulated or otherwise insulated dielectric bushing 1', in which at least one screening electrode 6; 6*a*, 6*b* according to the invention was omitted without any loss of dielectric strength or reliability. Instead of the screening electrode 6; 6*a*, 6*b*, a non-linear electric and/or dielectric field control element 9; 9*a*, 9*b*; 9*i*, 9*o*; 9*s* is provided on the insulator part 2; 2*a*, 2*b*; 2*c* in the region of the first installation flange 4 in order to realize the field control in the field-stressed zone 7; 7*a*, 7*b*. The field control element 9; 9*a*, 9*b*; 9*i*, 9*o*; 9*s* serves for the dielectric relief of the field-stressed zone 7; 7*a*, 7*b* instead of the screening electrode 6; 6*a*, 6*b* that was arranged on the insulator part 2; 2*a*, 2*b*; 2*c* in the state of the art. Preferred embodiments are discussed below.

Figure 2B:
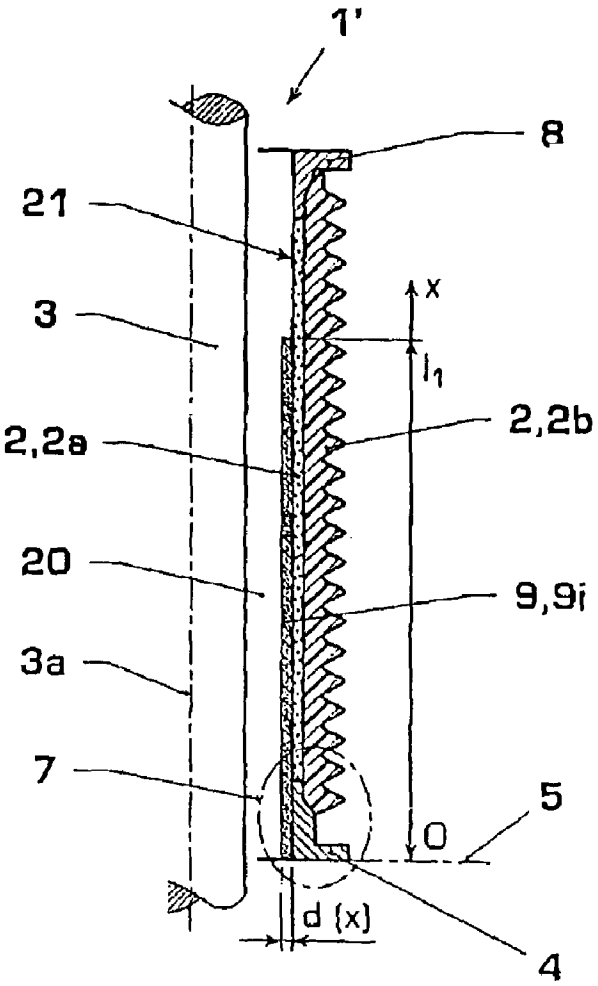
Figure 2A:
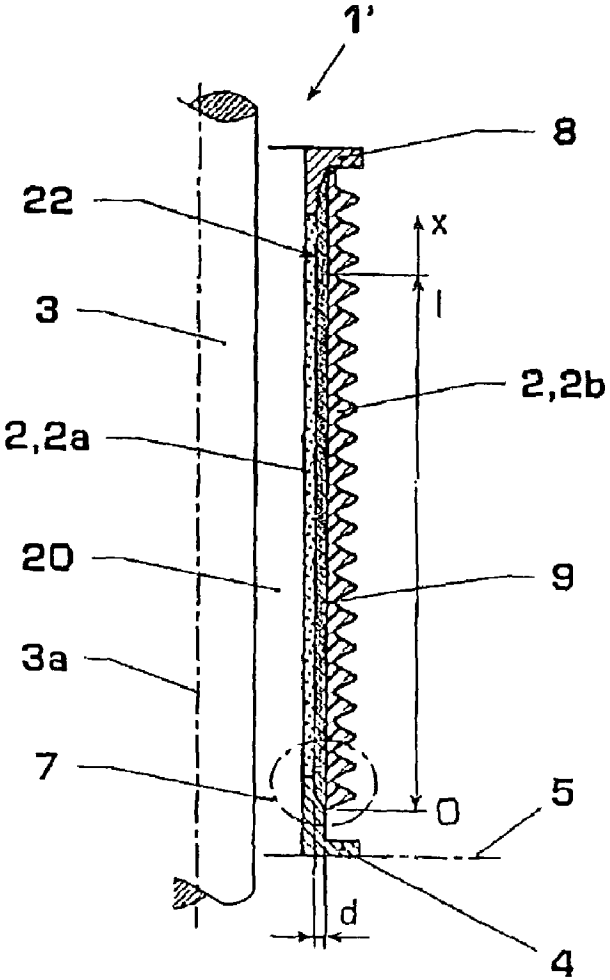

According to FIG. 2*a*, the field control element 9 for dielectrically relieving the field-stressed zone 7 is designed in such a way that the flange region 7 is stress-relieved. For this purpose, the field control element 9 is arranged in an intermediate layer 22 between the GFK tube (glass-fiber reinforced plastic tube, particularly an epoxy tube) 2*a* and the silicone screening 2*b* in the form of a coating that has the shape of a cylinder jacket. The field control element 9 may be applied onto the outer side of the GFK tube 2*a*, in particular, by means of any known manufacturing or processing method, e.g. by casting, spraying, winding, extrusion or the like.

The field control element 9; 9*a*, 9*b*; 9*i*, 9*o*; 9*s* preferably has the following characteristics: non-linear electric varistor properties and, in particular, a critical field strength that characterizes a varistor switching behavior of the field control element 9; 9*a*, 9*b*; 9*i*, 9*o*; 9*s* and/or a high permittivity $\epsilon$, for example, $\epsilon>30$, preferably $\epsilon>40$, in particular, $\epsilon>50$.

It is advantageous that the field control element 9 is in electric contact with the first installation flange 4 and extends over a predetermined length l along the longitudinal extension x of the insulator part 2; 2*a*, 2*b*. It has a predetermined thickness d or thickness distribution d(l) as a function of the length l. Its length l is preferably greater or equal to the ratio between a maximum impulse voltage to be tested, particularly a lightning impulse voltage, and the critical electric field strength. This design consideration advantageously applies to all embodiments, in which the screening electrode 6*a* in the region of the grounded flange 7*a* is replaced with the field control element of 9; 9*a*; 9*i*, 9*o*.

According to FIG. 2*b*, the field control material 9, 9*i* is arranged on an inner side 21 of the GFK tube 2*a* and may also assist in reducing surface charges at this location. In this case, the length $l_1$ is chosen, for example, such that the field control layer 9, 9*i* is not in electric contact with the opposite flange 8.

Figure 2D:
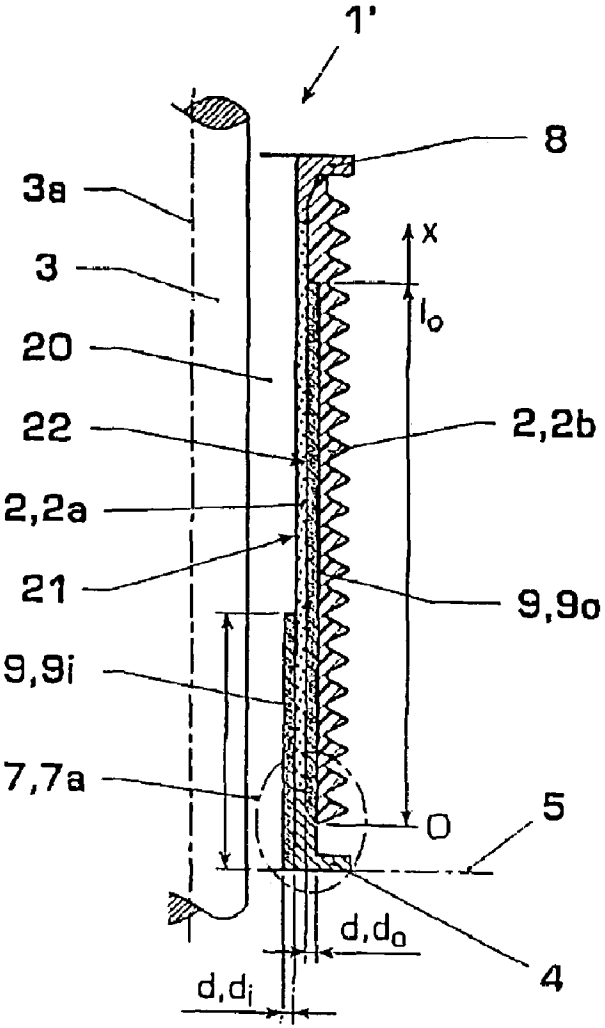
Figure 2C:
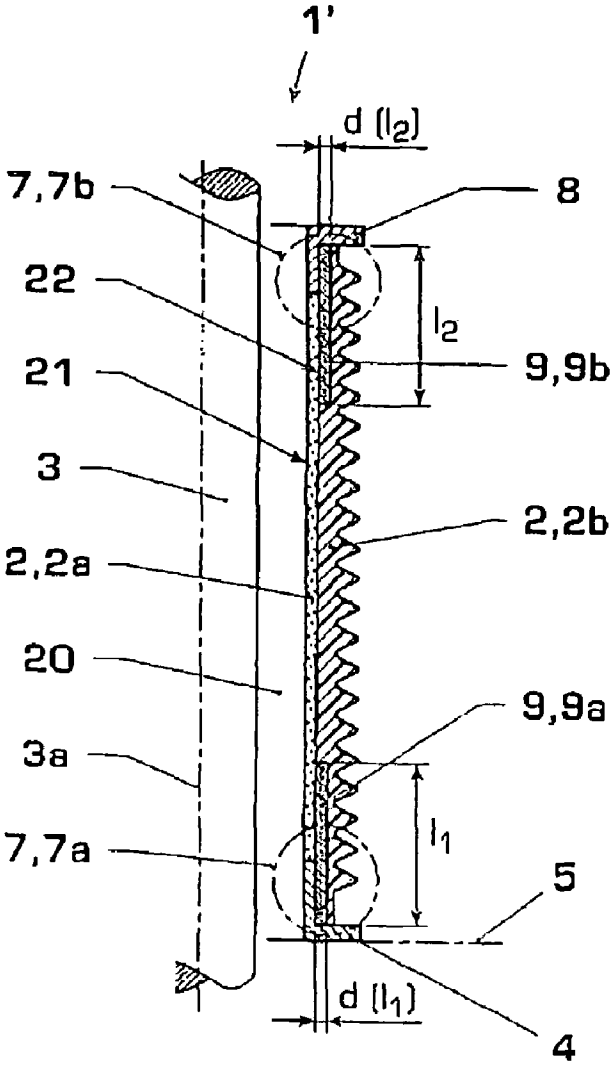

According to FIG. 2*c*, another field control element 9; 9*b* may be provided in addition to the field control element 9; 9*a*, wherein said additional field control element also has suitable non-linear electric and/or dielectric properties, particularly those described above with reference to the field control element 9; 9*a*, and is arranged on the insulator part 2; 2*a*, 2*b* in a field-stressed zone 7, 7*b* in the region of the second installation flange 8, namely over a predetermined length l; $l_2$ and thickness d or $d(l_2)$. The additional field control element 9; 9*b* serves, in particular, as a replacement for a screening electrode 6*b* in the region of the second installation flange 8 that forms the upper installation flange in this case. The field control element 9, 9*a* and the second field control element 9; 9*b* are also arranged in the intermediate layer 22 in this exemplary embodiment. The additional field control element 9, 9*b* preferably is in electric contact with the second installation flange 8 and/or the additional field control element 9, 9*b* is separated from the field control element 9; 9*a* in the region of the first installation flange 4 by a zone that is free of field control material and extends along the longitudinal direction of the insulator part 2; 2*a*, 2*b*.

According to FIG. 2*d*, a first field control element 9; 9*o* may be arranged in the intermediate layer 22 between the GFK tube 2*a* and the screening 2*b* and a second field control element 9, 9*i* may be arranged on the inner side 21 of the GFK tube 2*a* in the region of the grounded flange 7*a*. This results in an additionally improved field control. The first integrated and the second interior field control element 9*o*, 9*i* may be manufactured from identical or different field control materials and, in particular, varistor materials. The corresponding thicknesses $d_o$, $d_i$ and lengths $l_o$, $l_i$ may be chosen individually. For example, they are realized such that $d_i>d_o$ and $l_i<l_o$.

Figure 3B:
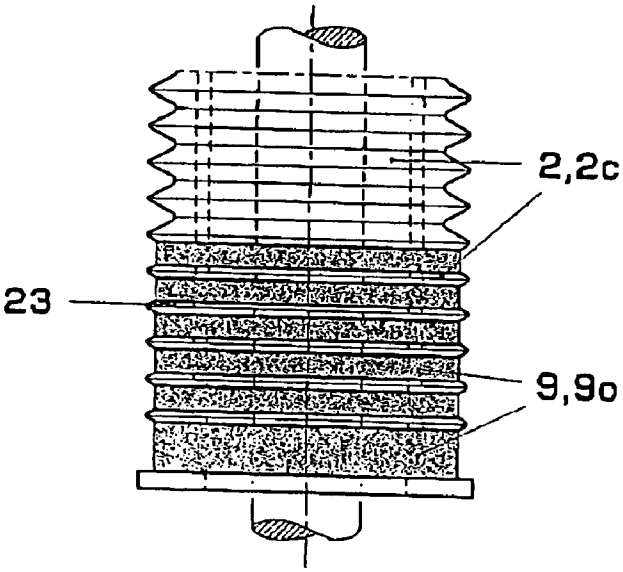
FIGS. 3*a*-3*b* show a cross section and a top view of embodiments of a FGM bushing for a porcelain insulator with an internal and an optional external FGM coating.
Figure 3A:
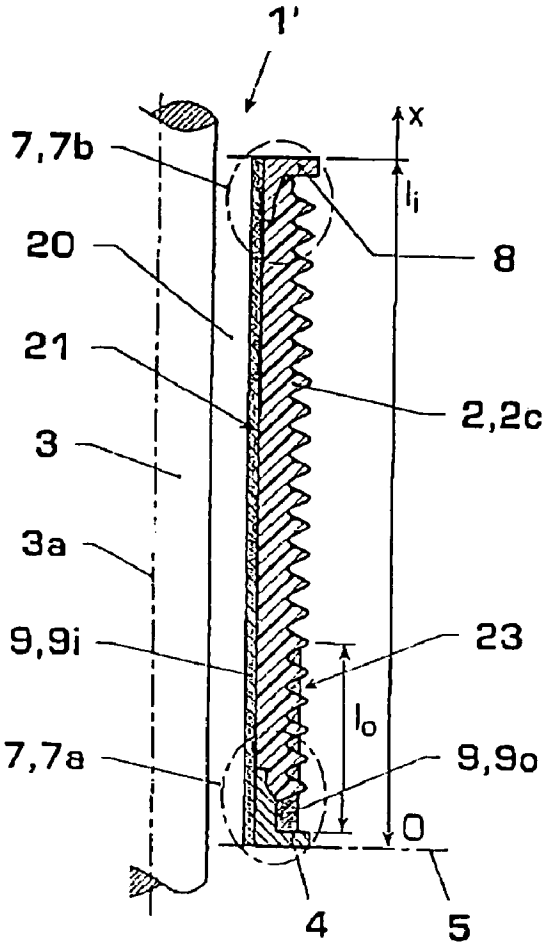

FIG. 3*a* and FIG. 3*b* show an insulator part 2, 2*c* in the form of a hollow porcelain insulator 2*c* that is equipped with the field control material 9, 9*i* on its inner side 21. Optionally, a field control material coating 9*o* may also be provided on the outer side 23, e.g. in disjunctive horizontal strips 9*o*, preferably between insulating screens 2*c* and, in particular, in the region of the lower grounded flange 7*a*. This means that the field control material 9; 9*a*, 9*b*; 9*i*, 9*o* may be realized in the form of a coating or of a massive element that is arranged on the inner side 21 and/or integrated into an intermediate layer 22 between components 2*a*, 2*b* of the insulator part 2; 2*a*, 2*b* and/or on an outer side 23 of the insulator part 2; 2*a*, 2*b*; 2*c*.

Figure 4:
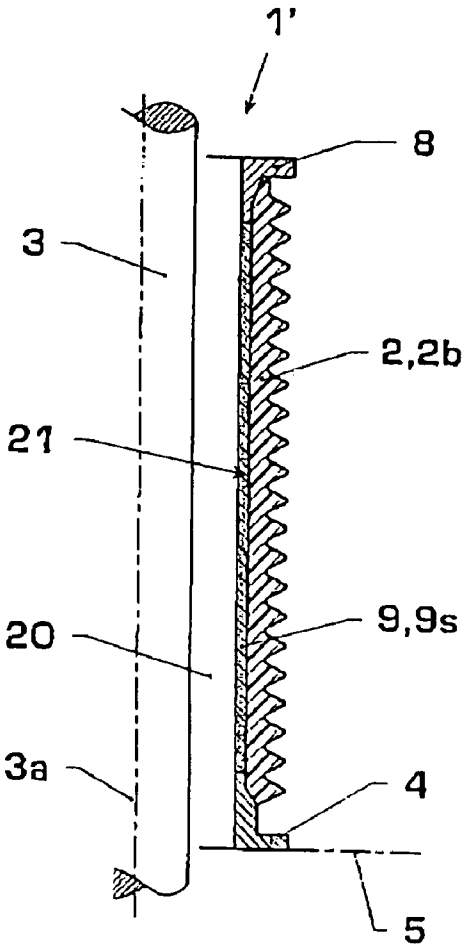
FIG. 4 shows a cross section through an embodiment of a self-supporting field control element with a silicone screening.

According to FIG. 4, the field control material 9; 9*s* assumes a mechanical support function. The field control material 9; 9*s* preferably assumes the exclusive mechanical self-supporting function of the insulator part 2; 2*b* such that a conventional self-supporting plastic tube 2*a* can be eliminated. Such a field control material insulating tube 2; 2*b* including 9*s* has a particularly simple design and is very thin with respect to its diameter.

For d.c. applications, the field control element 9; 9*i*; 9*s* according to FIG. 2*a*, FIG. 3*a* and FIG. 4 should be arranged on the insulator part 2; 2*a*, 2*b*; 2*c* over the entire surface and continuously over a length x of the insulator part 2; 2*a*, 2*b*; 2*c*, wherein said field control element should also be in electric contact with the first installation flange 4; 8 and with the second installation flange 8; 4.

One preferred material selection for the field control material 9; 9*a*, 9*b*; 9*i*, 9*o*; 9*s* comprises a matrix that is filled with micro-varistor particles and/or particles with high permittivity. For example, doped ZnO particles, $TiO_2$ particles or $SnO_2$ particles may be considered as micro-varistor particles. Examples of materials with high permittivity are $BaTiO_3$ particles or $TiO_2$ particles. If ZnO micro-varistor particles are used, they are typically sintered in the temperature range between 800° C. and 1200° C. After breaking up and, if so required, sieving the sintered product, the micro-varistor particles have a typical particle size of less than 125 μm. The matrix is chosen in dependence on the specific application and may comprise, for example, an epoxy, a silicone, an EPDM, a thermoplast, a thermoplastic elastomer or glass. The filling volume of the matrix with micro-varistor particles may lie, for example, between 20 vol. % and 60 vol. %.

Figure 5:
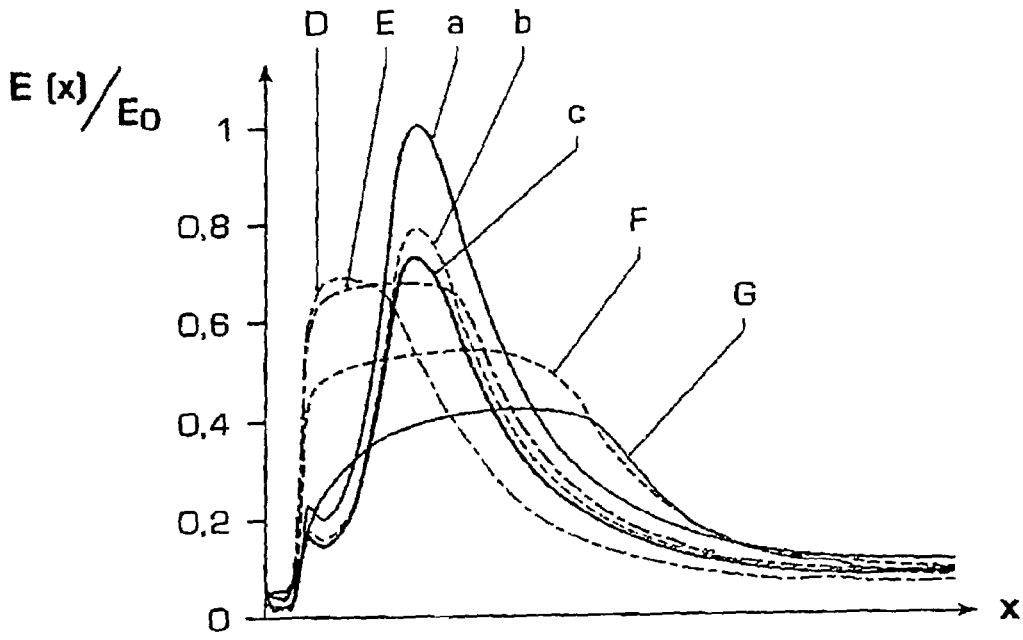
FIG. 5 shows surface electrical field distributions E(x) for lightning impulse voltage tests as a function of the geometric coordinate x along the bushing and as a function of the time, namely for conventional bushings (a, b, c) and for a FGM bushing according to the invention (D, E, F, G)

FIG. 5 shows calculations of the E-field distribution E(x) relative to a maximum E-field $E_o$ as a function of the longitudinal coordinate x of the insulator part 2 and the time, namely in the form of successive snapshots a, b, c for a conventional bushing 1 with a screening electrode 6 according to FIG. 1 and D, E, F, G for a bushing 1' according to the invention. The calculations were made for a $SF_6$ 170 kV bushing with GFK tube 2*a* and silicone screening 2*b* of conventional design 1 and the design 1' according to the invention. FIG. 5 shows the electric field strength E(x) at the silicone-air boundary surface during or shortly after applying a lightning impulse voltage, namely with time delays of 0.5 μs/2.2 μs/20 μs for the curves a, b, c and 0.5 μs/1.0 μs/5 μs/20 μs for the curves D, E, F, G. One can clearly ascertain that the E-field peaks are prevented with the new design of the bushing 1', and that a homogenous E-field distribution is achieved at all times. In addition, the regions of increased field strength are no longer stationary. This has advantageous effects on the dielectric behavior of the bushing 1'. The field control design of the bushing 1' can be optimized with the aid of the field calculations and the non-linear electric and/or dielectric properties of the field control material 9; 9*a*, 9*b*; 9*i*, 9*o*; 9*s*.

Figure 6:
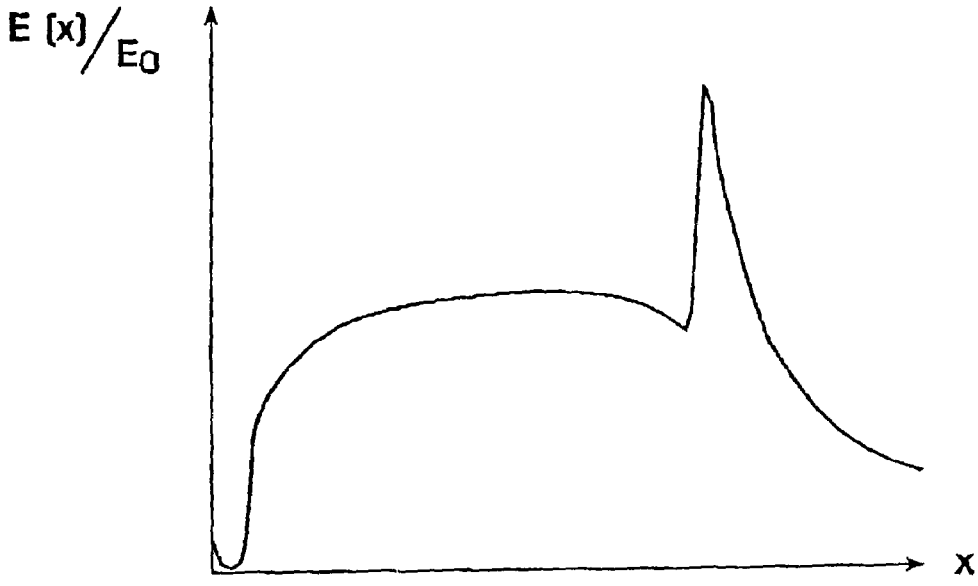
FIG. 6 shows an unfavorable field distribution E(x) for the case that the FGM coating is not sufficiently long or has an excessively high conductivity.

FIG. 6 shows an insufficient design, in which the field control element 9; 9*a*, 9*b*; 9*i*, 9*o*; 9*s* has an excessively high electric conductivity or an insufficient length l; $l_1$; $l_2$. This causes the E-field to propagate along the field control layer 9; 9*a*, 9*b*; 9*i*, 9*o*; 9*s*, wherein said field is not reduced during the propagation such that a field increase occurs once again at the end of the field control layer 9; 9*a*, 9*b*; 9*i*, 9*o*; 9*s*. This field increase can lead to partial discharges, sparkovers or dielectric breakdown. However, if the electric conductivity of the field control material 9; 9*a*, 9*b*; 9*i*, 9*o*; 9*s* is not sufficiently high, the E-field cannot be effectively managed or controlled. With respect to an optimal design of a varistor-type field control element 9; 9*a*; 9*i*, 9*o*; 9*s* in the region of the grounded flange 7, 7*a*, the invention proposes the simple but effective rule that the length l; $l_1$; $l_2$ of the field control element needs to be chosen greater or equal to a ratio between an impulse voltage and the critical electric field strength that characterizes the varistor switching behavior of the field control element 9; 9*a*, 9*b*; 9*i*, 9*o*; 9*s*.

The dielectric bushing l' according to the invention is suitable, among other things, for use as a bushing l' in an electrical high-voltage apparatus, particularly a disconnector, a life tank breaker, a vacuum circuit breaker, a dead tank breaker, a current transformer, a voltage transformer, a transformer, a power capacitor or a cable termination, or in an electrical switchgear assembly for high-voltage or medium-voltage levels. The invention also pertains to an electrical high-voltage apparatus, particularly a disconnector, a life tank breaker, a dead tank breaker, a current transformer, a voltage transformer, a transformer, a power capacitor or a cable termination, in which a dielectric bushing l' of the previously described type is provided. The invention also claims an electrical switchgear assembly, particularly a high-voltage or medium-voltage switchgear assembly, that comprises such an electrical high-voltage apparatus.

LIST OF REFERENCE SYMBOLS

1 Conventional high-voltage bushing
1' FGM high-voltage bushing
2 Self-supporting insulator
20 Insulation (solid, liquid, gel-like, gaseous), epoxy, cellular material, oil, air, $SF_6$
21 Inner side of the insulator part
22 Intermediate layer of the insulator part
23 Outer side of the insulator part
2*a* GFK tube (glass-fiber reinforced plastic), glass-fiber reinforced epoxy tube
2*b* Exterior insulator, screening, silicone screening
2*c* Porcelain insulator
3 Conductor (on high-voltage potential)
3*a* Center axis
3*b* Supply terminal
3*c* Supply terminal
4 Flange (grounded), grounded flange
46 Contact between flange and screening electrode
5 Housing of the high-voltage apparatus
6 Screening electrode
6*a* Screening electrode, ground electrode
6*b* Screening electrode, high-voltage electrode
7 Highly field-stressed zone
7*a* Field-stressed zone in the region of the grounded flange
7*b* Field-stressed zone in the region of the high-voltage flange
8 High-voltage flange
9 Field control material, FGM, varistor material, field control coating
9*a* FGM in the region of the grounded flange
9*b* FGM in the region of the high-voltage flange
9*i* FGM on the inner surface of the insulator
9*o* FGM on the outer surface of the insulator
9*s* self-supporting, field control insulating tube
a Conventional bushing after 0.5 μs
b Conventional bushing after 2.2 μs
c Conventional bushing after 20 μs
D FGM bushing after 0.5 μs
E FGM bushing after 1.0 μs
F FGM bushing after 5 μs
G FGM bushing after 20 μs
d, d(l) Thickness of the field control coating or the field control tube
$d_i$, $d_o$ Thickness of the field control inside layer or outside layer
l Length of the field control coating or the field control tube
$l_1$, $l_2$ Length of the field control coating in the region of the grounded flange or in the region of the high-voltage flange
E(x) Electric field distribution along high-voltage bushing
$E_o$ Maximum electric field, normalized field
x Geometric coordinate along the longitudinal direction of the FGM bushing

The invention claimed is:

1. A dielectric bushing, particularly a high-voltage bushing for an electrical high-voltage apparatus, comprising an insulator part with a first installation flange and a second installation flange for installing the bushing, wherein the insulator part contains in its interior a chamber for a solid insulating material, for an insulating liquid or for an insulating gas;

wherein a screening electrode required for the desired voltage level is omitted within the bushing in a field stress zone in the region of the first installation flange; and wherein a non-linear electric and/or dielectric field control element is instead provided in the field stress zone on the insulator part within the region of the first installation flange for field control purposes.

2. The bushing according to claim 1, wherein the field control material is designed, with respect to its non-linear electric and/or dielectric properties, its geometric shape and its arrangement on the insulator part, such that a dielectric relief of the field stress zone is achieved without a screening electrode in all operating states, particularly for impulse voltages.

3. The bushing according to claim 1, wherein the field control element has the following characteristics:

a) non-linear electric varistor properties and, in particular, a critical field strength that characterizes a varistor switching behavior of the field control element and/or b) a high permittivity $\epsilon$, $\epsilon>50$.

4. The bushing according to claim 1, wherein the field control element is in electric contact with the first installation flange.

5. The bushing according to claim 4, wherein the field control element extends over a predetermined length along the longitudinal direction of the insulator part and has a predetermined thickness or thickness distribution as a function of the length.

6. The bushing according to claim 5, wherein the length is greater or equal to the ratio between a maximum impulse voltage to be tested and the critical electric field strength, and wherein the field control element has non-linear electric varistor properties and, in particular, a critical field strength that characterizes a varistor switching behavior of the field control element.

7. The bushing according to claim 1, wherein, for d.c. applications, the field control element is arranged on the insulator part over the entire surface and continuously over a length of the insulator part, and said field control element is in electric contact with the first installation flange and with the second installation flange and wherein the field control element has non-linear electric varistor properties and, in particular, a critical field strength that characterizes a varistor switching behavior of the field control element.

8. The bushing according to claim 1, wherein:

a) the first installation flange consists of an installation flange on the ground side that serves for installing the bushing on a grounded housing of an electrical apparatus and/or b) the second installation flange consists of an installation flange on the voltage side that serves for installing the bushing on a high-voltage section.

9. The bushing according to claim 1, wherein:

a) the insulator part contains in its interior an insulation chamber for a solid insulating material or for an insulating liquid or b) the insulator part contains in its interior a gas chamber for an insulating gas.

10. The bushing according to claim 8, wherein:

a) another field control element is provided that has suitable non-linear electric and/or dielectric properties, and is arranged on the insulator part in a field-stressed zone in the region of the second installation flange, namely over a predetermined length and thickness, and wherein, b) in particular, the additional field control element serves as a replacement for a screening electrode in the region of the second installation flange.

11. The bushing according to claim 10, wherein:

a) the additional field control element is in electric contact with the second installation flange and/or b) the additional field control element is separated from the field control element in the region of the first installation flange by a zone that is free of field control material and extends along the longitudinal direction of the insulator part.

12. The bushing according to claim 1, wherein the field control element is realized in the form of a coating or a massive element:

a) that is arranged on the inner side of the insulator part; and/or b) that is integrated into an intermediate layer between components of the insulator part; and/or c) that is arranged on an outer side, particularly there in disjunctive horizontal strips, of the insulator part.

13. The bushing according to claim 1, wherein:

a) the field control element assumes a mechanical support function in the insulator part and, b) in particular, the field control element assumes the exclusive mechanical self-supporting function in the insulator part.

14. The bushing according to claim 1, wherein the field control element comprises a matrix, particularly an epoxy, a silicone, an EPDM, a thermoplast, a thermoplastic elastomer or glass, and the matrix:

a) is filled with microscopic varistor particles, particularly doped ZnO particles, $TiO_2$ particles or $SnO_2$ particles; and/or b) is filled with particles with high permittivity, particularly with $BaTiO_3$ particles or $TiO_2$ particles.

15. An electrical high-voltage apparatus, particularly a disconnector, an outdoor circuit breaker, a vacuum circuit breaker, a Dead Tank Breaker, a current transformer, a voltage transformer, a transformer, a power capacitor or a cable termination, wherein a dielectric bushing according to claim 1 is provided.

16. An electrical switchgear assembly, particularly a high-voltage or medium-voltage switchgear assembly, comprising an electrical high-voltage apparatus according to claim 15.

17. The bushing according to claim 10, wherein the another field control element has non-linear electric varistor properties and, in particular, a critical field strength that characterizes a varistor switching behavior of the field control element.

18. The bushing according to claim 7, wherein the field control element is in electric contact with the first installation flange.

19. The bushing according to claim 18, wherein the field control element extends over a predetermined length along the longitudinal direction of the insulator part and has a predetermined thickness or thickness distribution as a function of the length.

20. The bushing according to claim 1, wherein the field control element has the following characteristics:

a) non-linear electric varistor properties and, in particular, a critical field strength that characterizes a varistor switching behavior of the field control element and/or b) a high permittivity $\epsilon$, $\epsilon>40$.

21. The bushing according to claim 1, wherein the field control element has the following characteristics:

a) non-linear electric varistor properties and, in particular, a critical field strength that characterizes a varistor switching behavior of the field control element and/or b) a high permittivity $\epsilon$, $\epsilon>30$.

* * * * *